US005330403A

United States Patent [19]

Kuo

[11] Patent Number: 5,330,403

[45] Date of Patent: Jul. 19, 1994

[54] INFLATABLE PUNCHING DEVICE

[76] Inventor: James Y. Kuo, No. 57-12, Kuang-Ming Rd., Taichung City, Taiwan

[21] Appl. No.: 116,290

[22] Filed: Sep. 3, 1993

[51] Int. Cl.[5] ..... A63B 69/34

[52] U.S. Cl. ..... 482/83; 273/55 A; 482/90

[58] Field of Search ..... 482/23, 33, 83–90, 482/148, 121, 129; 273/55 A, 26 R

[56] References Cited

U.S. PATENT DOCUMENTS

| | | | |
|---|---|---|---|
| D. 199,984 | 1/1965 | Mitchell | 482/33 |
| 1,085,505 | 1/1914 | Stafford | 482/33 |
| 1,884,816 | 10/1932 | Oakes | 273/55 A |
| 2,085,161 | 6/1937 | Kraus | 482/90 |
| 2,184,453 | 12/1939 | Hayes | 482/90 |
| 2,186,403 | 1/1940 | Bullis et al. | 482/90 |
| 2,197,545 | 4/1940 | Bachman et al. | 482/85 |
| 3,475,019 | 10/1969 | Mutter et al. | 482/33 |
| 4,486,016 | 12/1984 | Rubin | 482/90 |
| 4,903,966 | 2/1990 | Liao | 482/90 |

FOREIGN PATENT DOCUMENTS

| | | | |
|---|---|---|---|
| 021280 | 11/1992 | Australia | 482/90 |
| 286512 | 1/1991 | Fed. Rep. of Germany | 482/83 |
| 0318719 | 9/1929 | United Kingdom | 482/90 |

*Primary Examiner*—Stephen R. Crow
*Assistant Examiner*—Jerome Donnolly
*Attorney, Agent, or Firm*—Baker & Daniels

[57] ABSTRACT

A punching device includes an inflatable cylinder-shaped bag which serves as a punching bag when inflated and a hollow casing which is filled with sand or water and which supports the cylinder-shaped bag resiliently and vertically thereon.

4 Claims, 4 Drawing Sheets

INFLATABLE PUNCHING DEVICE

BACKGROUND OF THE INVENTION

1. Field of the Invention

The invention relates to a punching device, more particularly to a punching device which includes an inflatable punching bag.

2. Description of the Prior Art

FIG. 1 shows a conventional punching device which is used for practicing kicks and punches by a boxer, martial arts practitioners and the like. The conventional punching device includes a bag 101 that is filled with sand and that is suspended from a high position by means of a rope 102.

Some of the drawbacks resulting from the use of the conventional punching device are as follows:

(1) The sand bag 101 is heavy and cannot be moved easily to a desired place.

(2) Since the sand bag 101 does not swing even if it is continuously punched because of its heavy weight, the sand bag 101 is unable to produce counter punches.

(3) A boxer cannot practice swiftness and punch-avoiding tactics when the sand bag 101 is in use.

FIG. 2 shows another conventional punching device which includes a base plate 1, a vertical stand 2 fixed on the base plate 1 adjacent to one end thereof, and a punching bag 4 which is connected to a top end of the vertical stand 2 by means of a resilient member 3. The punching bag 4 is stuffed with clothing material or cotton.

During practice, one foot of the puncher steps on the base plate 1 in order to prevent collapsing of the vertical stand 2 due to the force applied on the punching bag 4. Movement of the legs of the puncher is thus prevented. In order to overcome this drawback, the base plate 1 can be made of a heavy material such as cement or the like, so that the punching device will not topple when the bag 4 is punched. This solution, however, results in another drawback. The increased weight of the punching device makes it more difficult to move the same to a desired place. Furthermore, the punching device requires a relatively large space, thus making it inconvenient to store.

SUMMARY OF THE INVENTION

A main objective of the present invention is to provide a punching device that includes a punching bag which is inflatable. The punching device is relatively light and can be moved to a desired place easily.

A second objective of the present invention is to provide a punching device that includes a resilient connecting unit which connects the inflatable bag to a support unit so that the inflatable bag swings when punched and generates counter blows from unexpected directions.

A third objective of the present invention is to provide a punching device which has a support unit that does not need to be stepped on so that the user can practise movement of his legs while punching the bag.

Accordingly, the punching device of the present invention includes a support unit with a hollow casing that has an inlet for filling the same and an engaging rod that projects vertically from the hollow casing. A tube-like spring coil is provided on the hollow casing such that one end of the engaging rod is squeezed into the tube-like spring coil. A connecting rod has a bottom end squeezed into an upper end of the tube-like spring coil so that the latter permits the former to extend vertically therefrom. An inflatable cylinder-shaped bag has two opposed ends. A tubular member is disposed in the bag and is formed integrally with the bag. The tubular member extends from one of the opposed ends of the bag to define an axial blind bore therein. The connecting rod is inserted tightly in the blind bore so that the bag is retained resiliently by the connecting rod relative to the casing.

In use, the bag is inflated so as to serve as a punching bag. When the bag is punched, it swings back and forth so that the user can practise how to avoid advancing punches.

Since the bag is made of a lightweight air-impermeable material, and since the casing can be emptied when desired, the punching device of the present invention can be moved to a desired place easily.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
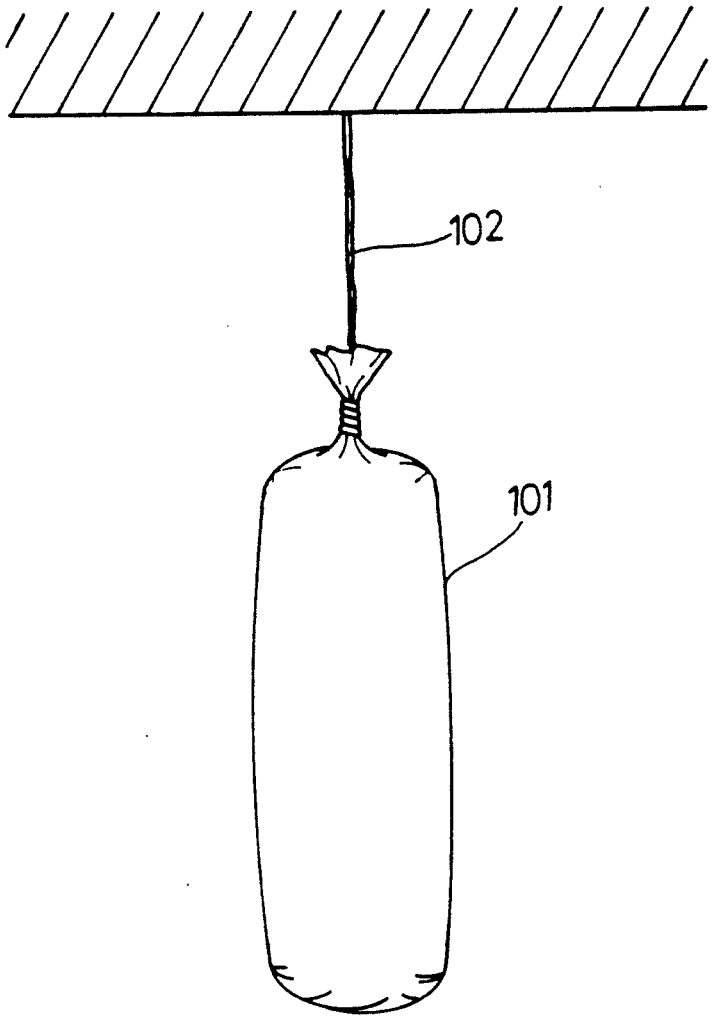
FIG. 1 (PRIOR ART)
FIG. 1 shows a conventional punching device.
Figure 2:
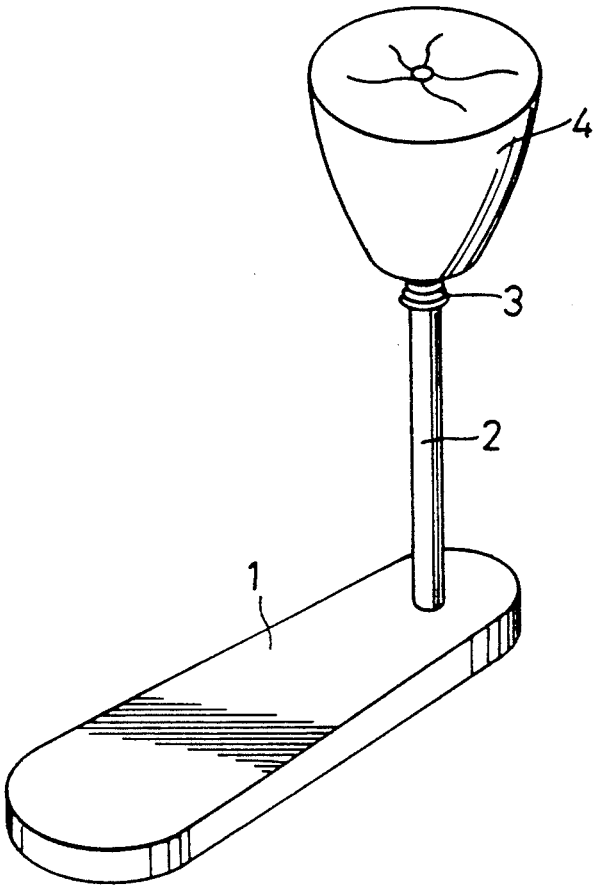
FIG. 2 (PRIOR ART)
FIG. 2 shows another conventional punching device.
Figure 3:
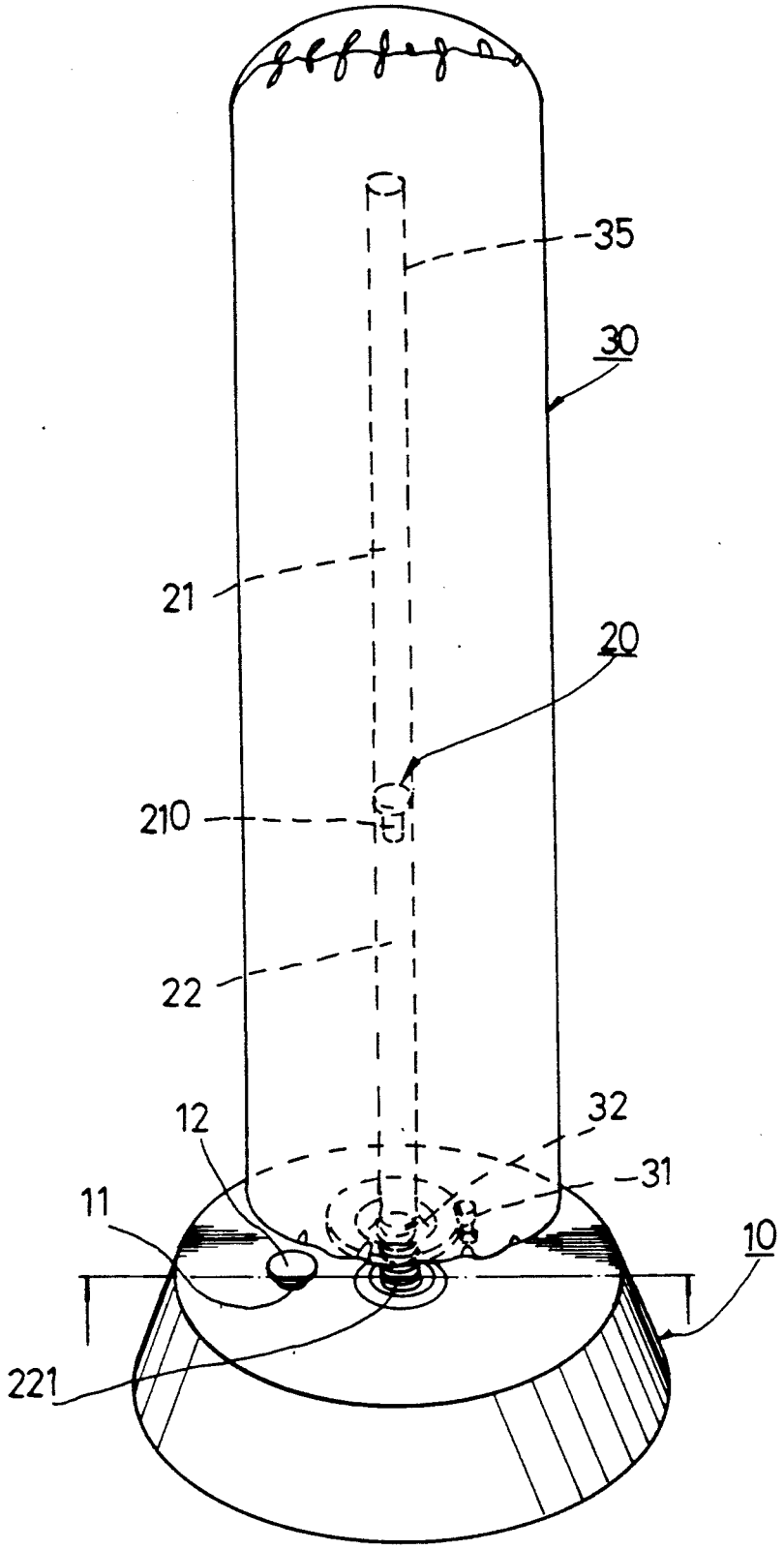
FIG. 3 shows a perspective, schematic view of a punching device of the present invention.
Figure 4:
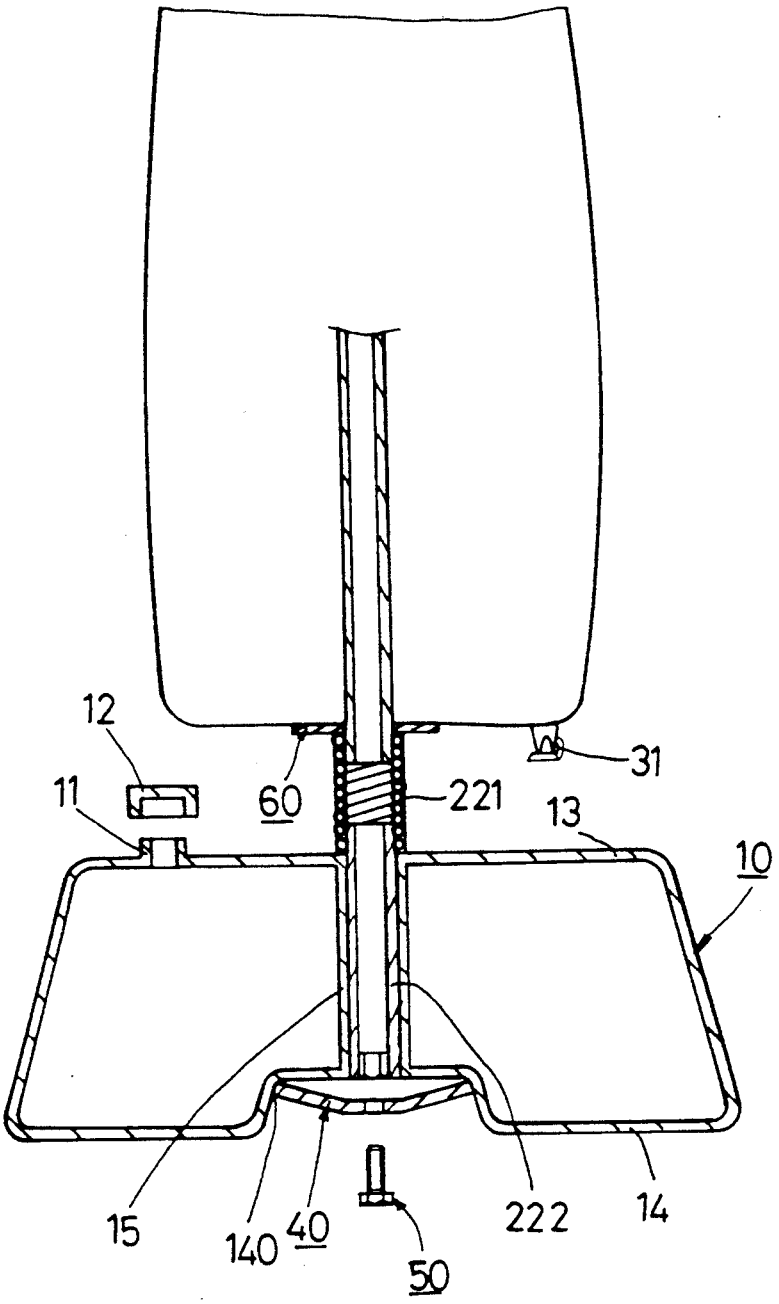
FIG. 4 shows a cross-sectional view of the punching device of the present invention, demonstrating how an inflatable cylinder-shaped bag is mounted on a hollow casing of a support unit.

Referring to FIG. 3 and 4, the punching device of the present invention includes a support unit which has a hollow casing 10 with an inlet 11 and a tubular wall that extends from a top 13 to a bottom 14 of the casing 10, thereby defining a through hole 15. A cap 12 is used to close the inlet 11 after the casing 10 is filled with sand or water so that the latter does not move easily. The bottom 14 has a recess 140 which is communicated with the through hole 15.

An inflatable cylinder-shaped bag 30, which is made from a lightweight, air-impermeable material, is used as a punching bag in the present invention. The cylinder-shaped bag 30 has two opposed ends and an inflating head 31 for air injection purposes. A tubular member extends from one of the opposed ends to define an axial blind bore 35 therein.

An engaging rod 222 is inserted slidably into the through hole 15 of the casing 10. A curved washer ring 40 is placed in the recess 140 at the bottom 14 of the casing 10. A locking screw 50 extends through the washer ring 40 to fasten the engaging rod 222 relative to the casing 10 in such a manner that a .section of the engaging rod 222 extends from a topmost portion of the casing 10.

A tube-like spring coil 221 is disposed vertically on the casing 10. The engaging rod 222 is squeezed into a lower end of the tube-like spring coil 221.

A connecting rod 20 has a bottom end inserted tightly into an upper end of the tube-like spring coil 221 such that the connecting rod 20 extends vertically from the tube-like spring coil 221. A top end of the connecting rod 20 is inserted into the blind bore 35 in the inflatable cylinder-shaped bag 30, thereby completing the connection of the cylinder-shaped bag 30 and the casing 10.

Note that the blind bore 35 in the cylinder-shaped bag 30 should engage the connecting rod 220 tightly in order to ensure that the former will not disengage the latter when a user punches the cylinder-shaped bag 30.

To facilitate storage of the punching device when the latter is not in use, the connecting rod 20 can be formed of two sections 21, 22 which are connected to one another by means of a male-female connection at a joint 210. The cylinder-shaped bag 30 can be deflated when not in use so that only a small amount of storage space is needed to store the punching device of the present invention.

A support plate 60 can be sleeved on the connecting rod 20 and is disposed on the tube-like spring coil 221. When the cylinder-shaped bag 30 is inflated, the support plate 60 supports the inflated cylinder-shaped bag 30 vertically on the tube-like spring coil 221.

Since the cylinder-shaped bag 30 is connected to the casing 10 resiliently, the cylinder-shaped bag 30 moves away from the user when the cylinder-shaped bag 30 is punched. The bag 30 moves back toward the user due to the action of tube-like spring coil 221, thus providing a counter blow to the user.

The casing 10 is filled with water or sand and is heavy enough so that the punching device does not topple due to the application of a punching force even though the user does not step on the support unit. Thus, the user can practise movement of his legs while practising his punches.

When not in use, the bag 30 can be deflated and removed from the connecting rod 20. The connecting rod 20, the tube-like spring coil 221 and the engaging rod 222 can be disassembled, and the sand in the casing 10 can be emptied so that storage of the punching device is facilitated. The punching device is lightweight so that it can be conveniently carried and installed at any desired place.

While a preferred embodiment has been explained and described, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. An inflatable punching device, comprising:

a portable base for ground support with a hollow casing that confines a receiving space therein and that has an inlet for filling said receiving space;

an engaging rod projecting vertically from said casing;

a tube-like spring coil provided vertically on said casing, said engaging rod being squeezed into a lower end of said tube-like spring coil;

a connecting rod having a bottom end squeezed into an upper end of said tube-like spring coil so that said tube-like spring coil engages resiliently said engaging rod and said connecting rod together and permits said connecting rod to extend vertically from said tube-like spring coil; and an inflatable cylinder-shaped bag being made of an air impermeable material and having two opposed ends, a tubular member having only one open end being disposed in said cylinder-shaped bag and being formed integrally with said cylinder-shaped bag, said tubular member extending substantially the full length of said bag axially from one of said opposed ends to define a blind bore in said cylinder-shaped bag, said connecting rod having substantially its full length inserted tightly into said blind bore so as to retain said cylinder-shaped bag on said connecting rod, said cylinder-shaped bag further having valve means connected thereto.

2. The inflatable punching device as defined in claim 1, further comprising a support plate sleeved on said connecting rod and disposed on said upper end of said tube-like spring coil to support said one of said opposed ends of said inflatable cylinder-shaped bag when said bag is inflated.

3. The inflatable punching device as defined in claim 1, wherein said casing has a through hole extending from a top to a bottom of said casing, said bottom of said casing being formed with a recess that is communicated with said through hole.

4. The inflatable punching device as defined in claim 3, wherein said engaging rod extends into said through hole, a curved washer ring being provided in said recess, and a locking screw passing through said curved washer ring and fastening threadedly said engaging rod.

* * * * *